US005567506A

United States Patent [19]

Sogabe

[11] Patent Number: 5,567,506

[45] Date of Patent: Oct. 22, 1996

[54] THERMAL TRANSFER RECORDING MEDIUM

[75] Inventor: Jun Sogabe, Osaka, Japan

[73] Assignee: Fujicopian Co., Ltd., Osaka, Japan

[21] Appl. No.: 234,533

[22] Filed: Apr. 28, 1994

[30] Foreign Application Priority Data

Apr. 30, 1993 [JP] Japan ..... 5-104652

[51] Int. Cl.[6] ..... B41M 5/40

[52] U.S. Cl. ..... 428/212; 428/195; 428/206; 428/323; 428/341; 428/484; 428/913; 428/914

[58] Field of Search ..... 428/195, 206, 428/211, 484, 488.1, 488.4, 913, 914, 212, 323, 341

[56] References Cited

U.S. PATENT DOCUMENTS 4,783,360 11/1988 Katayama et al. ..... 428/212
4,880,686 11/1989 Yaegashi et al. ..... 428/212
5,362,548 11/1994 Hiyoshi et al. .

*Primary Examiner*—Pamela R. Schwartz
*Attorney, Agent, or Firm*—Fish & Neave

[57] ABSTRACT

A thermal transfer recording medium comprising a foundation, a heat-meltable release layer provided on the foundation, and a heat-meltable colored ink layer provided on the release layer, the heat-meltable release layer comprising wax particles having an average particle size of 1 to 6 μm, the coating amount of the particles being from 0.3 to 2.5 g/m$^2$, the average particle size R (μm) and the coating amount M (g/m$^2$) of the particles satisfying the relationship represented by formula (I):

$$0.28R \leqq M \leqq 0.83R \quad (I)$$

The specific release layer provides a great adhesion force of the ink layer to the foundation when not being heated and a good releasability of the ink layer from the foundation when the ink ribbon is peeled from the receptor paper when printing.

5 Claims, No Drawings

THERMAL TRANSFER RECORDING MEDIUM

BACKGROUND OF THE INVENTION

The present invention relates to an improvement in a thermal transfer recording medium having a release layer between a foundation and a heat-meltable colored ink layer.

Hitherto, in the case of a thermal transfer recording medium of the type capable of forming printed images of satisfactory quality even on a paper sheet of poor surface smoothness (hereinafter referred to as "rough paper"), generally, there has been employed a heat-meltable ink layer exhibiting bridging characteristics (i.e., a heat-meltable ink layer capable of being transferred as bridging over depressed portions of the rough paper). For the purpose of obtaining a heat-meltable ink layer having enhanced bridging characteristics, there is used a heat-meltable vehicle composed mainly of a resin and having a great cohesive force as the vehicle of the heat-meltable ink.

A thermal transfer recording medium used for printing bar codes on labels, and the like, also employs a heat-meltable vehicle composed mainly of a resin and having a high cohesive force because printed images with good fastness are required.

However, when a thermal transfer recording medium having on a foundation such a heat-meltable ink layer of which the vehicle is composed mainly of a resin is brought into contact with a receptor paper, and after being heated with a thermal head, peeled from the receptor paper when printing, a heated portion of the heat-meltable ink layer retains a great adhesion force to the foundation and is hard to come off from the foundation, which results in a poor transfer.

A way of improving the transferability of the ink layer has been adopted wherein a release layer composed mainly of a wax and having a low melt viscosity is interposed between the ink layer and the foundation.

However, the use of such a release layer having a low melt viscosity for improving the releasability of the ink layer from the foundation when printing causes the following problems.

(1) Since the adhesion force between the ink layer and the foundation is weak when not being heated before printing, the phenomenon called "falling of ink like a powder" (hereinafter referred to as "ink-falling") occurs. The ink-falling phenomenon means that the ink layer is peeled off from the foundation in a powdery form even by action of a small physical force such as rubbing.

(2) Since the adhesion force between the release layer and the ink layer is weak, the unheated portion of the ink layer adjacent to a heated portion of the ink layer is peeled from the release layer together with the heated portion to be transferred to a receptor paper, which means that undesired transfer of the ink layer takes place. In the phenomenon, there occurs smearing of the receptor paper with the ink like a tail on the opposite side of the printed image relative to the traveling direction of the thermal head. Thus, the phenomenon is also called "tailing phenomenon".

When a release layer having a high melt viscosity is used to eliminate the aforesaid drawbacks, the releasability of the ink layer from the foundation when transferring is poor, so that it makes no sense to provide the release layer. Further, since the foundation is subject to a great force when the ink ribbon is peeled from the receptor paper, wrinkles are produced in the foundation to cause an extraordinarily larger diameter of the roll of the ink ribbon wound on the take-up reel in the ribbon cassette to make it difficult to rewind the entire length of the ink ribbon and to cause uneven end surfaces of the roll of the ink ribbon wound on the take-up reel. The wrinkles also cause an unevenness in the travel of the ink ribbon and dropout portions in printed images.

On the other hand, Japanese Unexamined Patent Publication No. 61-268485 discloses a technique wherein a layer composed of a fine powder is provided between the foundation and the ink layer to improve the releasability of the ink layer. However, since the fine powder layer does not contain a heat-meltable binder such as wax, the adhesion force of the layer to the foundation is weak, so that the aforesaid ink-falling phenomenon is likely to occur. If the adhesion force of the powder layer to the foundation is increased, for example, by elevating the drying temperature in coating in order to prevent the ink-falling phenomenon, the releasability of the ink layer from the foundation when transferring is poor.

In view of the foregoing, an object of the present invention is to provide a thermal transfer recording medium wherein the adhesion force of the ink layer to the foundation is strong when not being heated before printing and the releasability of the ink layer from the foundation is good when the ink ribbon is peeled from the receptor paper in printing, thereby causing no problems such as ink-falling phenomenon and tailing phenomenon.

This and other objects of the present invention will become apparent from the description hereinafter.

SUMMARY OF THE INVENTION

The present invention provides a thermal transfer recording medium comprising a foundation, a heat-meltable release layer provided on the foundation, and a heat-meltable colored ink layer provided on the release layer, the heat-meltable release layer comprising particles comprising a wax and having an average particle size of 1 to 6 μm, the coating amount of the particles being from 0.3 to 2.5 g/m$^2$, the average particle size and the coating amount of the particles satisfying the relationship represented by formula (I):

$$0.28R \leqq M \leqq 0.83R \quad \text{(I)}$$

wherein R is the average particle size of the particles in terms of μm, and M is the coating amount of the particles in terms of g/m$^2$.

DETAILED DESCRIPTION

According to the present invention, the release layer is composed of particles containing a wax as the major component, which improves the releasability of the ink layer in heated portions when printing. The feature that the average particle size and the coating amount of the particles and the relationship between the average particle size and the coating amount fall within the foregoing ranges provides such a structure that the ink of the ink layer reaches the foundation through the clearances between the particles to adhere to the foundation, thereby bonding the ink layer and the foundation to each other by means of the ink. The structure provides a great adhesion force between the ink layer and the foundation when not being heated, thereby preventing the ink-falling phenomenon. The structure also provides a great adhesion force between the ink layer and the release layer, thereby preventing the undesired transfer of the ink layer or the tailing phenomenon. Since the releasability of the ink layer in heated portions when transferring is good as mentioned above, the foundation is not subject to a great force when the ink ribbon is peeled from the receptor, thereby causing no wrinkles in the foundation.

The reason why the undesired transfer of the ink or the tailing phenomenon does not occur when the adhesion force between the ink layer and the release layer is strong is as follows: F1 denotes the interfacial shear force between the heated portion and the unheated portion of the ink layer at the time when the recording medium is peeled from the receptor after the recording medium is heated with a thermal head. F2 denotes the adhesion force between the release layer and the ink layer in the unheated portion.

When the condition: F2<F1 holds, the ink layer in the heated portion is peeled adjacent to the heated portion. When the condition: F1<F2 holds, the ink layer is separated at the interface between the heated portion and the unheated portion, so that the undesired transfer of the ink layer does not occur.

As described above, the release layer of the present invention provides a great adhesion force between the ink layer and the foundation when not being heated before printing and a small adhesion force between the ink layer and the foundation when being heated in printing. In contrast thereto, the release layer composed of a fine powder alone disclosed in the above-mentioned Japanese Unexamined Patent Publication No. 61-268485 does not provide a great difference between the adhesion force of the ink layer to the foundation in the unheated state and that in the heated state.

According to the present invention, the release layer is formed from particles composed of a wax as the major component.

Examples of the aforesaid wax include natural waxes such as haze wax, bees wax, carnauba wax, candelilla wax, montan wax and ceresine wax; petroleum waxes such as paraffin wax and microcrystalline wax; synthetic waxes such as oxidized wax, ester wax, polyethylene wax, Fischer-Tropsch wax and α-olefin-maleic anhydride copolymer wax; higher fatty acids such as myristic acid, palmitic acid, stearic acid and behenic acid; higher aliphatic alcohols such as stearyl alcohol and docosanol; esters such as higher fatty acid monoglycerides, sucrose fatty acid esters and sorbitan fatty acid esters; and amides and bisamides such as stearic acid amide and oleic acid amide. These waxes may be used either alone or in combination.

Among these waxes, there are preferably used those having a low melt viscosity. Examples of such waxes include carnauba wax, candelilla wax, montan wax, paraffin wax, ester wax and Fischer-Tropsch wax.

The melting or softening point of the wax is preferably from about 50° to 130° C. for the usual transfer conditions. The melt viscosity required for the wax varies depending upon the transfer conditions, and the like, and cannot be determined unconditionally. Generally, however, the melt viscosity of the wax is not higher than 1,000 cps, preferably not higher than 100 cps, at a temperature that is 30° C. higher than the melting or softening point of the wax. The lower limit of the melt viscosity of the wax is about 3 cps at the temperature.

The average particle size of the wax particles is from 1 to 6 μm. When the average particle size is smaller than the above range, the resulting wax particle layer resembles a continuous wax film, so that the effect of holding the ink when not being heated or the effect of releasing the ink when being heated for transfer is not sufficiently exhibited. When the average particle size is greater than the above range, the thickness of the release layer is excessively large, so that the heat conduction degrades, resulting in a poor transferability.

The coating amount ( on a dry weight basis, hereinafter the same) of the particles composed of a wax as the major component is from 0.3 to 2.5 g/m$^2$. When the coating amount of the particles is less than the above range, the release effect is insufficient. When the coating amount of the particles is more than the above range, the heat diffusion is unfavorably marked.

Further, it is preferable to change the coating amount of the particles for the release layer depending upon the average particle size of the particles used so that the coating amount is decreased with decreasing the average particle size. That is, they are determined such that the average particle size R in terms of μm and the coating amount M of the particles in terms of g/m$^2$ satisfy the relationship represented by formula (I):

$$0.28R \leqq M \leqq 0.83R \quad (1)$$

When the average particle size of the particles composed of a wax as the major component, the coating amount of the particles and the relationship between the average particle size and the coating amount fall within the aforesaid ranges, the ink of the ink layer passes through the clearances between the particles to reach the foundation, thereby exhibiting an anchor effect.

The release layer is formed by applying a solvent dispersion or emulsion of the particles composed of a wax as the major component to a foundation, followed by drying. The drying temperature is set to such a temperature range that the particles are neither melted nor dissolved.

A surface active agent may be used in preparation of the solvent dispersion or emulsion. Examples of the surface active agent include alkyl sulfates, alkylbenzenesulfonates, higher fatty acid salts, alkylnaphthalenesulfonates, dialkyl sulfosuccinates, naphthalenesulfonate-formaldehyde polycondensation products, polyoxyethylene alkyl ether sulfate and alkylamine salts. Cationic surface active agents, anionic surface active agents and nonionic surface active agents other than the foregoing may be used. If necessary, a heat-meltable resin may be used as a binder in an amount of not more than 20% by weight on the basis of the weight of the release layer.

As the heat-meltable colored ink layer in the present invention, there can be used conventional colored ink layers having a high melt viscosity with no particular limitation.

Examples of the heat-meltable colored ink layer include those composed of a coloring agent and a heat-meltable vehicle having a high melt viscosity as the essential components, and optionally a dispersing agent or a body pigment. Usable as the heat-meltable vehicle having a high melt viscosity are those composed of a heat-meltable resin as the major component and optionally a wax.

The softening point of the ink layer is preferably from about 50° to 170° C. The melt viscosity of the ink layer is preferably from about 103 to 109 cps at a temperature that is 30° C. higher than the softening point.

Examples of the aforesaid heat-meltable resin (including elastomer) include olefin copolymer resins such as ethylene-vinyl acetate copolymer and ethylene-acrylic ester copolymer, polyamide resins, polyester resins, epoxy resins, polyurethane resins, acrylic resins, vinyl chloride resins, cellulosic resins, vinyl alcohol resins, petroleum resins, phenolic resins, styrene resins, vinyl acetate resins, natural rubber, styrene-butadiene rubber, isoprene rubber, chloroprene rubber, polyisobutylene and polybutene. These heat-meltable resins may be used either alone or in combination.

Usable as the aforesaid wax are those exemplified for the release layer.

Usable as the aforesaid coloring agent are any coloring agents conventionally used in a heat-meltable ink of this type. Examples of such coloring agents include various inorganic or organic pigments or dyes as well as carbon black. The content of the coloring agent in the ink layer is usually about 10 to 50% by weight.

The heat-meltable colored ink layer can be formed by applying onto the release layer a coating liquid prepared by dissolving or dispersing the aforesaid ink components into a solvent which does not substantially dissolve the particles of the wax, followed by drying at such a temperature that the particles of the wax is neither melted nor dissolved. The coating amount of the ink layer is preferably from about 0.5 to 6 g/m$^2$.

Usable as the foundation in the present invention are polyester films such as polyethylene terephthalate film, polyethylene naphthalate film, polyarylate film and polybutylene terephthalate film, polycarbonate films, polyamide films, aramid films and other various plastic films commonly used for the foundation of an ink ribbon of this type. Thin paper sheets with a high density such as condenser paper can also be used. From the viewpoint of improving heat conduction, the thickness of the foundation is preferably within the range of about 1 to 10 μm, more preferably about 2 to 7 μm.

When the aforesaid plastic film is used as the foundation, the back side (the side adapted to be brought into slide contact with the thermal head) of the foundation may be provided with a conventionally known stick-preventive layer composed of one or more of various heat-resistant resins such as silicone resin, fluorine-containing resin, nitrocellulose resin, other resins modified with these heat-resistant resins including silicone-modified acrylic resins, and mixtures of the foregoing heat-resistant resins and lubricating agents.

The present invention will be described in more detail by way of examples thereof. It is to be understood that the present invention is not limited to these examples, and various changes and modifications may be made in the invention without departing from the spirit and scope thereof.

EXAMPLES 1 to 2 and COMPARATIVE EXAMPLES 1 to 2

A polyethylene terephthalate (PET) film with a thickness of 3.5 μm was used having a stick-preventive layer composed of a silicone-modified acrylic resin in a thickness of 0.1 μm on one side thereof. Onto the other side of the PET film was coated a wax dispersion prepared by adding 10 parts by weight of the wax for release layer shown in Table 1 together with a surface active agent into 90. parts by weight of toluene, heating the mixture to dissolve the wax and then cooling the solution to precipitate particles of the wax, followed by drying at 50° C. to form a released layer.

In Comparative Example 1, the same wax used in Example 1 was applied onto the PET film by a hot-melt coating method, followed by drying to give a continuous wax layer in a coating amount of 1.0 g/m$^2$.

In Comparative Example 2, a dispersion of a colloidal silica in methanol was applied onto the PET film, followed by drying to give a colloidal silica layer in a coating amount of 1.0 g/m$^2$.

TABLE 1

| | Ex. 1 | Ex. 2 | Com. Ex. 1 | Com. Ex. 2 |
|---|---|---|---|---|
| Formula (% by weight) | | | | |
| Particles of carnauba wax* (average particle size: 3 μm) | 100 | — | 100 | — |
| Particles of carnauba wax* (average particle size: 5 μm) | — | 100 | — | — |
| Colloidal silica (particle size: 10 to 20 μm) | — | — | — | 100 |
| Coating amount (g/m$^2$) | 1.0 | 2.0 | 1.0 | 1.0 |

*Melting point: 86° C.
Melt viscosity: 29 cps/116° C.

In turn, onto the release layer thus formed was coated the below-mentioned coating liquid for ink layer, followed by drying at 50° C. to form an ink layer having a softening point of 110° C. and a melt viscosity of $3\times10^7$ cps/140° C. in a coating amount of 2.0 g/m$^2$.

Coating liquid for ink layer

| Components | Parts by weight |
|---|---|
| Ethylene-vinyl acetate copolymer resin (softening point: 60° C.) | 10 |
| Carbon black | 8 |
| Porous silica powder (average particle size: 4 μm) | 2 |
| Toluene | 30 |
| Methyl ethyl ketone | 50 |

Each of the thermal transfer recording media thus obtained was subjected to printing tests using a thermal transfer printer (PC-PR 150 V made by NEC Corporation) and evaluated for the following items. A sheet of paper, Xerox 4024 (Bekk smoothness: 28 seconds), was used as a receptor paper. The results are shown in Table 2.

(A) Transferability

Printing was performed at the maximum printing energy (0.1 mJ/dot). The reflection density (OD value) of the resulting printed image was measured and rated into the following three stages:

3 . . . OD value≧1.5

2 . . . 1.0≦OD value<1.5

1 . . . OD value<1.0

(B) Ink-falling phenomenon

Printing was performed under the same conditions as in the above. The condition of peeling of the ink layer from the foundation in the unused part of the ink ribbon was observed and rated into the following three stages:

3 . . . Any delamination or peeling of the ink layer from the foundation was not observed.

2 . . . Partial delamination of the ink layer from the foundation was observed.

1 . . . Peeling of the ink layer from the foundation was observed.

(C) Undesired transfer of ink

Printing was performed under the same conditions as in the above. A magnified photograph (25 times) of the resulting printed image was taken and the condition of the undesired transfer of ink was observed and rated into the following two stages.

2 . . . No undesired transfer occurred.

1 . . . Undesired transfer occurred.

TABLE 2

| | Ex. 1 | Ex. 2 | Com. Ex. 1 | Com. Ex. 2 |
|---|---|---|---|---|
| Transferability | 3 | 2 | 3 | 1 |
| Ink-falling phenomenon | 3 | 3 | 1 | 2 |
| Undesired transfer of ink | 2 | 2 | 1 | 1 |

In addition to the materials and ingredients used in the Examples, other materials and ingredients can be used in the Examples as set forth in the specification to obtain substantially the same results.

As described above, the release layer provided between the foundation and the colored ink layer according to the present invention is a layer which is composed of particles of a wax having an average particle size of 1 to 6 μm and has a coating amount of 0.3 to 2.5 g/m$^2$, and satifies the aforesaid specific relationship between the average particle size and the coating amount. The release layer provides a great adhesion force between the ink layer and the foundation when not being heated, thereby preventing the ink-falling phenomenon. The release layer also provides a great adhesion force between the ink layer and the release layer, thereby preventing the undesired transfer of the ink layer or the tailing phenomenon. Further, the release layer provides a good releasability of the ink layer in heated portions when transferring, so that the foundation is not subject to a great force when the ink ribbon is peeled from the receptor, thereby causing no wrinkles in the foundation.

What is claimed is:

1. A thermal transfer recording medium comprising a foundation, a heat-meltable release layer provided on the foundation, and a heat-meltable colored ink layer provided on the release layer, the heat-meltable release layer comprising particles comprising a wax and having an average particle size of 1 to 6 μm, the wax having a melting or softening point of 50° to 130° C. and a melt viscosity of not more than 1,000 cps at a temperature that is 30° C. higher than the melting or softening point of the wax, the coating amount of the particles being from 0.3 to 2.5 g/m$^2$, the average particle size and the coating amount of the particles satisfying the relationship represented by formula (I):

$$0.28R \leqq M \leqq 0.83R \quad \text{(I)}$$

wherein R is the average particle size of the particles in terms of μm, and M is the coating amount of the particles in terms of g/m$^2$, said relationship resulting in clearances between the particles through which the heat-meltable ink layer reaches to adhere to the foundation.

2. The thermal transfer recording medium of claim 1, wherein the heat-meltable colored ink layer has a softening point of 50° to 170° C. and a melt viscosity of $10^3$ to $10^0$ cps at a temperature that is 30° C. higher than the softening point of the ink layer.

3. The thermal transfer recording medium of claim 1, wherein the wax has a melt viscosity of not more than 100 cps at a temperature that is 30° C. higher than the melting or softening point of the wax.

4. A thermal transfer recording medium comprising a foundation, a heat-meltable release layer provided on the foundation, and a heat-meltable colored ink layer provided on the release layer, the heat-meltable release layer consisting essentially of particles consisting essentially of a wax and having an average particle size of 1 to 6 μm, the wax having a melting or softening point of 50° to 130° C. and a melt viscosity of not more than 1,000 cps at a temperature that is 30° C. higher than the melting or softening point of the wax, the coating amount of the particles being from 0.3 to 2.5 g/m$^2$, the average particle size and the coating amount of the particles satisfying the relationship represented by formula (I):

$$0.28R \leqq M \leqq 0.83R \quad \text{(I)}$$

wherein R is the average particle size of the particles in terms of μm, and M is the coating amount of the particles in terms of g/m$^2$, said relationship resulting in clearances between the particles through which the heat-meltable ink layer reaches to adhere to the foundation.

5. A thermal transfer recording medium comprising a foundation, a heat-meltable release layer provided on the foundation, and a heat-meltable colored ink layer provided on the release layer, the heat-meltable release layer comprising particles comprising a wax and having an average particle size of 1 to 6 μm, the wax having a melting or softening point of 50° to 130° C. and a melt viscosity of not more than 1,000 cps at a temperature that is 30° C. higher than the melting or softening point of the wax, the coating amount of the particles being from 0.3 to 2.5 g/m$^2$, the average particle size and the coating amount of the particles satisfying the relationship represented by formula (I):

$$0.28R \leqq M \leqq 0.83R \quad \text{(I)}$$

wherein R is the average particle size of the particles in terms of μm, and M is the coating amount of the particles in terms of g/m$^2$, the heat-meltable colored ink layer having a softening point of 50° to 170° C. and a melt viscosity of $10^3$ to $10^9$ cps at a temperature that is 30° C. higher than the softening point of the ink layer.

* * * * *